US007791553B2

(12) United States Patent
Conrad

(10) Patent No.: US 7,791,553 B2
(45) Date of Patent: Sep. 7, 2010

(54) HIGH WIND ELEVATION MECHANISM FOR A SATELLITE ANTENNA SYSTEM

(75) Inventor: Timothy J. Conrad, Mt. Pleasant, IA (US)

(73) Assignee: Winegard Company, Burlington, IA (US)

( * ) Notice: Subject to any disclaimer, the term of this patent is extended or adjusted under 35 U.S.C. 154(b) by 0 days.

(21) Appl. No.: 12/100,547

(22) Filed: Apr. 10, 2008

(65) Prior Publication Data

US 2009/0040130 A1 Feb. 12, 2009

Related U.S. Application Data

(60) Provisional application No. 60/911,780, filed on Apr. 13, 2007.

(51) Int. Cl.
*H01Q 3/12* (2006.01)

(52) U.S. Cl. ..... 343/761; 343/711; 343/713; 343/912; 343/915

(58) Field of Classification Search ..... 343/711, 343/713, 761, 912, 915
See application file for complete search history.

(56) References Cited

U.S. PATENT DOCUMENTS

| | | | |
|---|---|---|---|
| 3,412,404 | A | 11/1968 | Bergling |
| 3,646,564 | A | 2/1972 | Drislane |
| 4,663,633 | A | 5/1987 | Wilson |
| 4,725,843 | A | 2/1988 | Suzuki et al. |
| 4,771,293 | A | 9/1988 | Williams et al. |
| 4,811,026 | A | 3/1989 | Bissett |
| 4,873,526 | A | 10/1989 | Katsuo |
| 4,887,091 | A | 12/1989 | Yamada |
| 4,994,816 | A | 2/1991 | Kondo |
| 5,337,062 | A | 8/1994 | Sherwood et al. |
| 5,418,542 | A | 5/1995 | Sherwood et al. |
| 5,515,065 | A | 5/1996 | Sherwood et al. |
| 5,528,250 | A | 6/1996 | Sherwood et al. |
| 5,554,998 | A | 9/1996 | Sherwood et al. |
| 5,646,638 | A | 7/1997 | Winegard et al. |
| 5,760,751 | A | 6/1998 | Gipson |
| 5,929,817 | A | 7/1999 | Clark |
| 5,952,980 | A | 9/1999 | Boling |
| 5,966,104 | A | 10/1999 | Massey et al. |
| 5,999,139 | A | 12/1999 | Benjamin et al. |
| 6,124,836 | A | 9/2000 | Rogers |
| 6,462,718 | B1 | 10/2002 | Ehrenberg et al. |
| 6,507,324 | B2 | 1/2003 | Overton et al. |
| 6,535,177 | B1 | 3/2003 | Dhellemmes et al. |

(Continued)

*Primary Examiner*—Douglas W Owens
*Assistant Examiner*—Dieu Hien T Duong
(74) *Attorney, Agent, or Firm*—W. Scott Carson

(57) ABSTRACT

An elevation mechanism for a satellite antenna system. The elevation mechanism includes tilt links or arms, lift links, and a linear actuator with an adjustable length leg arrangement. Each tilt arm is pivotally mounted at its inner and outer end portions to the base or azimuth plate of the system and to the back of the dish of the system. Similarly, each lift link is pivotally mounted at its inner and outer end portions to the base and to the back of the dish. The linear actuator in turn is pivotally mounted at its inner end portion to the base and at its outer end portion to the lift links. In operation, the linear actuator can be moved between extended and retracted positions to cause the dish to move between its stowed position facing downwardly and a deployed position facing upwardly of the horizon at a targeted satellite.

16 Claims, 15 Drawing Sheets

U.S. PATENT DOCUMENTS

| | | | |
|---|---|---|---|
| 6,573,871 | B2 | 6/2003 | Drews et al. |
| 6,714,170 | B2 | 3/2004 | Kleinschmidt |
| 6,734,830 | B1 | 5/2004 | Bickham |
| 7,230,581 | B2 | 6/2007 | McEwan |
| 2004/0077309 | A1 | 4/2004 | Brass et al. |
| 2004/0125035 | A1 | 7/2004 | Noro et al. |
| 2004/0160375 | A1 | 8/2004 | King |
| 2006/0038728 | A1 * | 2/2006 | McEwan ..... 343/713 |

* cited by examiner

HIGH WIND ELEVATION MECHANISM FOR A SATELLITE ANTENNA SYSTEM

RELATED APPLICATION

This application claims the benefit of U.S. Provisional Patent Application Ser. No. 60/911,780 filed Apr. 13, 2007, which application is incorporated herein by reference.

BACKGROUND OF THE INVENTION

1. Field of the Invention

This invention relates to the field of satellite antenna systems in which the dish of the system can be easily and quickly elevated from a stowed position facing downwardly to a deployed position targeted on a satellite.

2. Discussion of the Background

Satellite antenna systems mounted on recreational or similar vehicles or otherwise intended for use outdoors need to have elevation mechanisms that can easily and quickly move the dish of the system between stowed and deployed positions. In the stowed position, the dish preferably faces downwardly for protection from the elements including wind and snow. In the deployed position, the dish is typically directed upwardly (e.g., at 40-45 degrees from the horizon) toward a satellite.

With larger dishes (e.g., one meter or more across and 40 or more pounds) and dishes of all sizes exposed to high winds and other elements such as snow, the elevation mechanism must additionally be very strong and stable. Otherwise, the elevation mechanism may not be able to raise and lower the dish in adverse conditions or maintain it in a stable deployed position targeted on the satellite to receive and/or send signals.

With this and other problems in mind, the present invention was developed. In it, an elevation mechanism is disclosed that is strong enough to easily and quickly raise and lower dishes of all sizes and weights in virtually all conditions including high winds and snow. Additionally, the elevation mechanism can achieve improved resolution with the satellite and maintain it in all operating positions and under virtually all conditions.

SUMMARY OF THE INVENTION

This invention involves an elevation mechanism for a satellite antenna system. The elevation mechanism includes tilt links or arms, lift links, and a linear actuator with an adjustable length leg arrangement. Each tilt arm is pivotally mounted at its inner and outer end portions to the base or azimuth plate of the system and to the back of the dish of the system. Similarly, each lift link is pivotally mounted at its inner and outer end portions to the base and to the back of the dish. The linear actuator in turn is pivotally mounted at its inner end portion to the base and at its outer end portion to the lift links adjacent the dish.

In operation, the linear actuator can be moved between extended and retracted positions to cause the dish to move between its stowed and deployed positions. In the stowed position, the dish faces downwardly and in a deployed position, the dish faces upwardly of the horizon at the targeted satellite. The linear actuator has a longer stroke than in prior designs which allows for finer control of the deployed position of the dish for improved resolution. Additionally, the overall configuration of the elevation mechanism provides a very strong arrangement for moving the dish between its stowed and deployed positions including in adverse conditions of high winds and snow and provides a very stable support for the dish in all of its positions even under such adverse conditions.

BRIEF DESCRIPTION OF THE DRAWINGS

FIGS. 4*a*-6*a* correspond to the sequential views of FIGS. 4-6 but with the main body of the dish removed for clarity.

FIGS. 7*a*-9*a* are additional perspective views corresponding to the views of FIGS. 4*a*-6*a*.

DETAILED DESCRIPTION OF THE INVENTION

Figure 1:
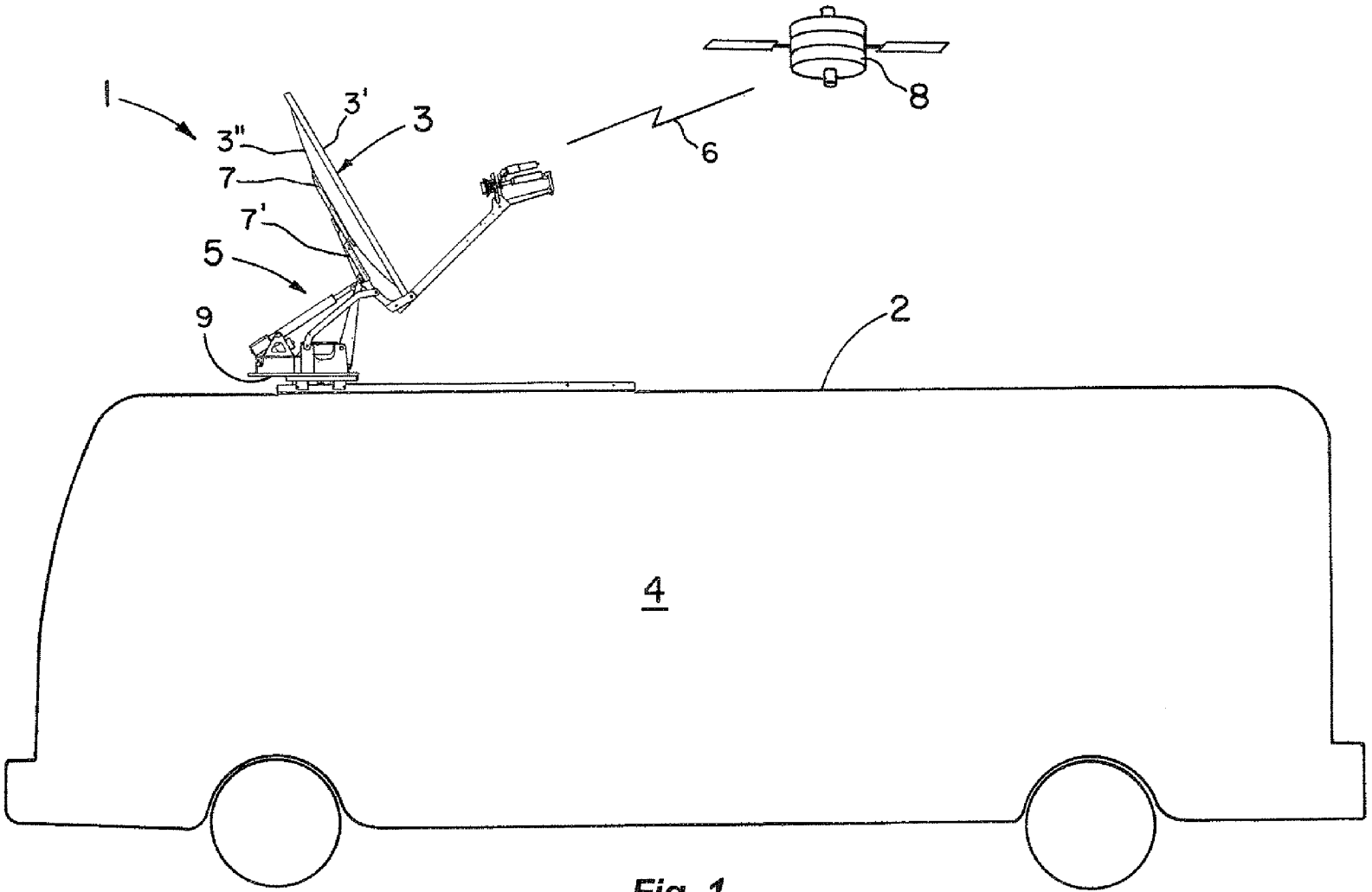
FIG. 1 is a schematic view of the antenna system of the present invention mounted on a recreational or other vehicle with the dish in a raised or deployed position targeted on a satellite.
Figure 2:
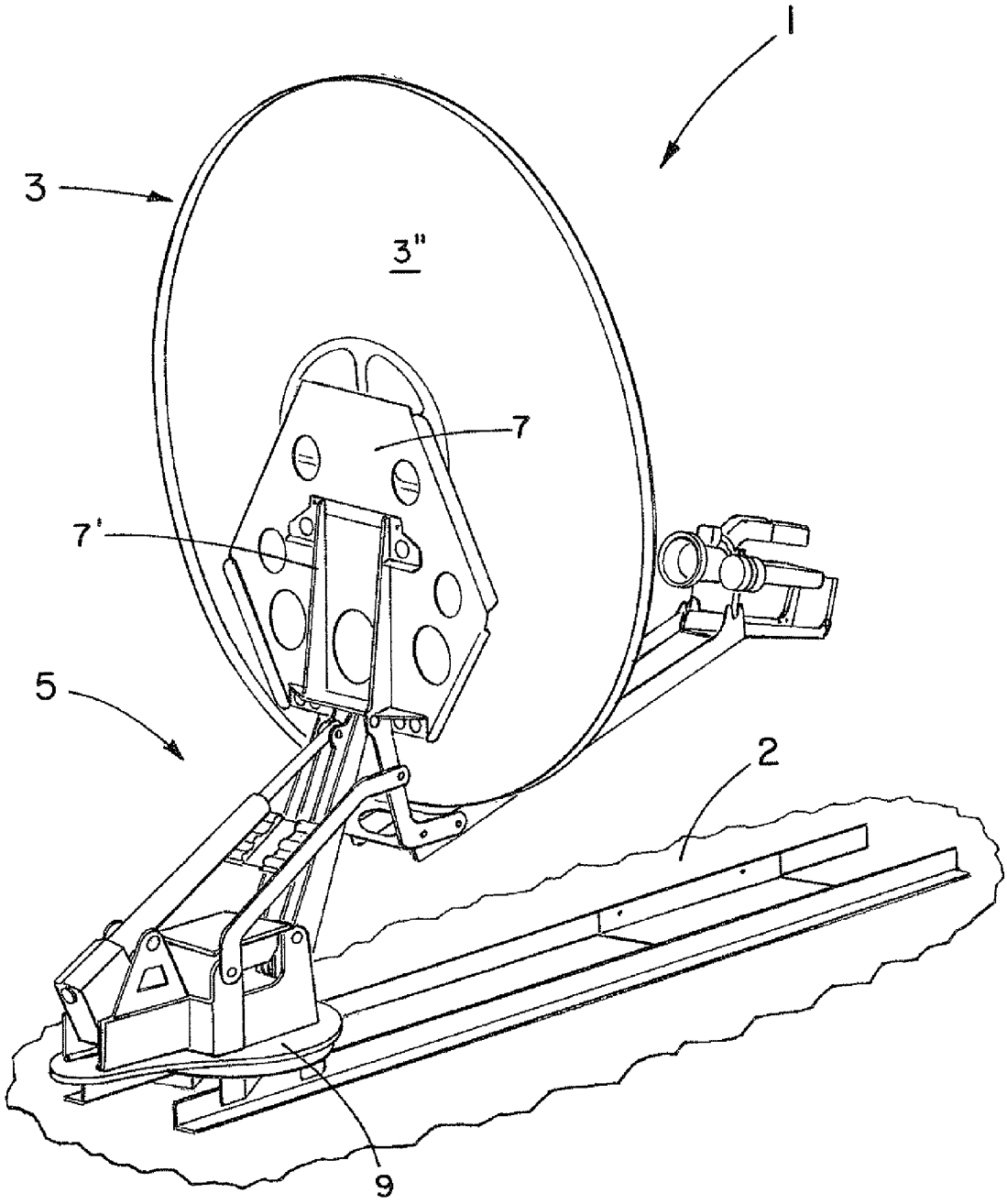
FIG. 2 is a rear perspective view of the antenna system of FIG. 1.
Figure 3:
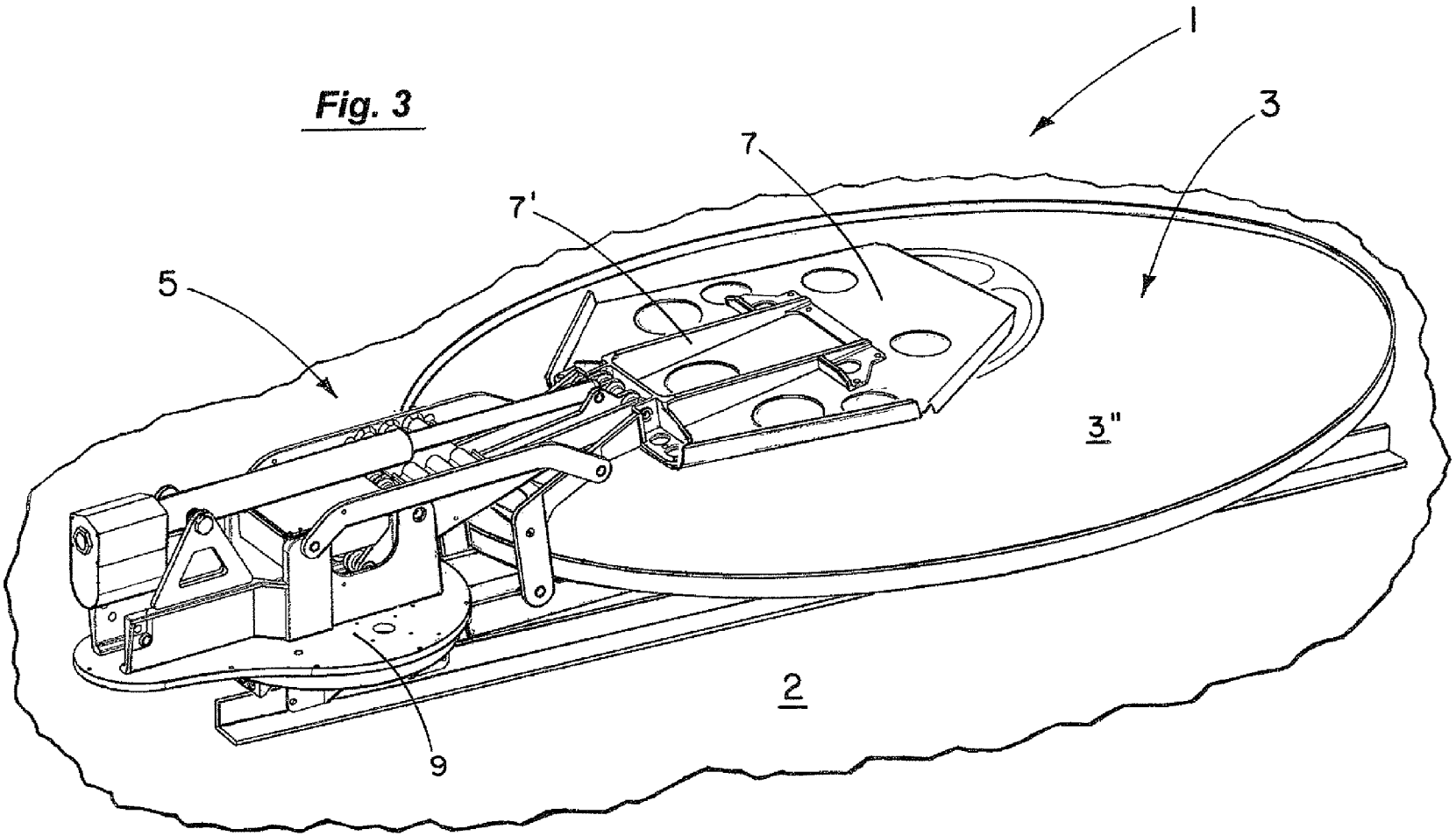
FIG. 3 is a view similar to FIG. 2 but with the dish in its lowered or stowed position substantially flush with the vehicle roof.

FIGS. 1 and 2 illustrate the satellite system 1 of the present invention with the dish member 3 in a raised or deployed position atop the roof 2 of a recreation vehicle 4. The dish member 3 in this regard is targeted in FIG. 1 to communicate (receive and/or send signals 6) with the satellite 8. In FIG. 3, the dish member 3 is shown in a lowered or stowed position substantially flush against the vehicle roof 2. The controls for the positioning of the satellite system 1 (e.g., azimuth, elevation, deployed, and stowed) are preferably motorized and operated remotely from within the vehicle 4 in a conventional manner.

Figure 4:
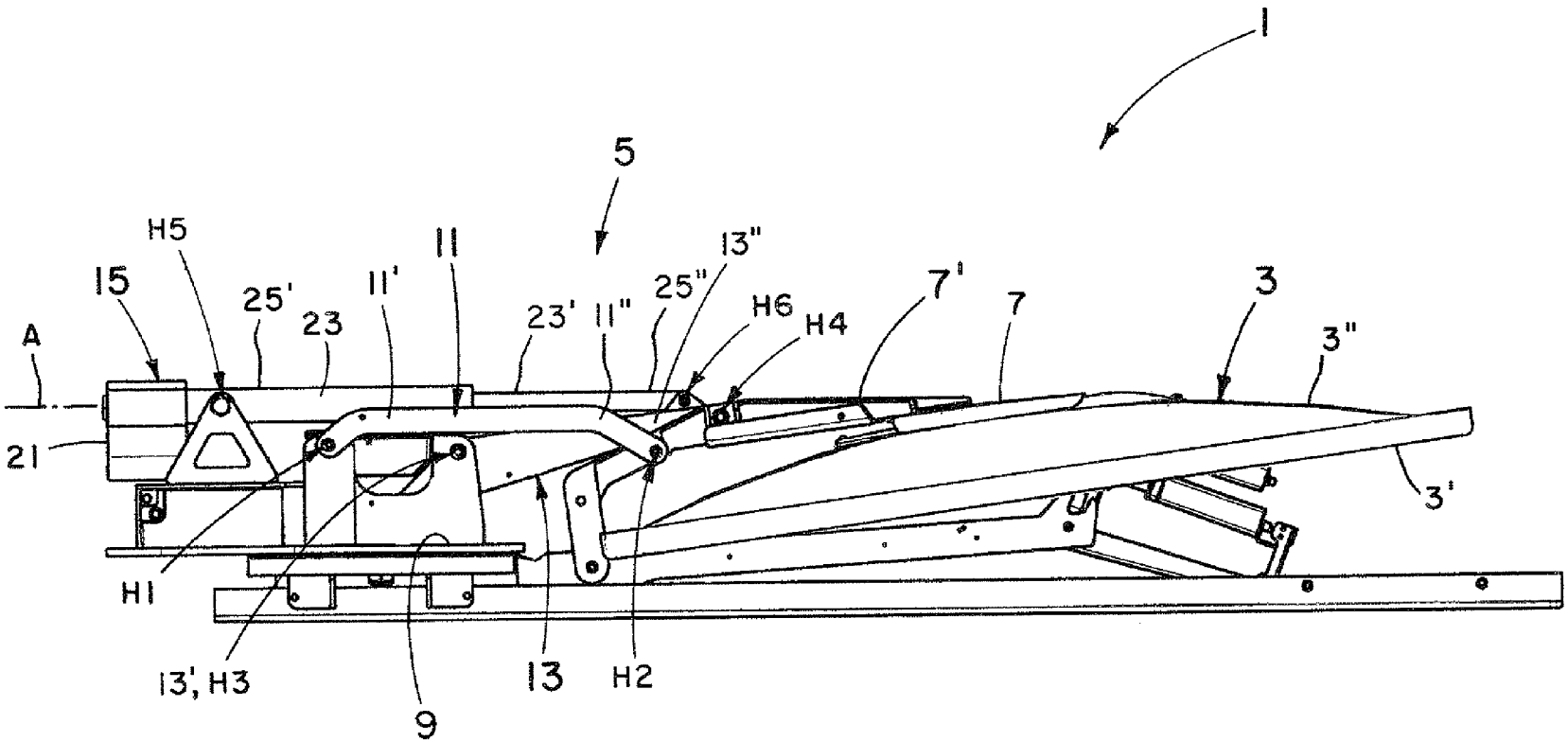
FIGS. 4-6 sequentially show the dish of the antenna system being raised from its stowed position of FIG. 4 to a deployed position of FIG. 5 or 6.
Figure 4A:
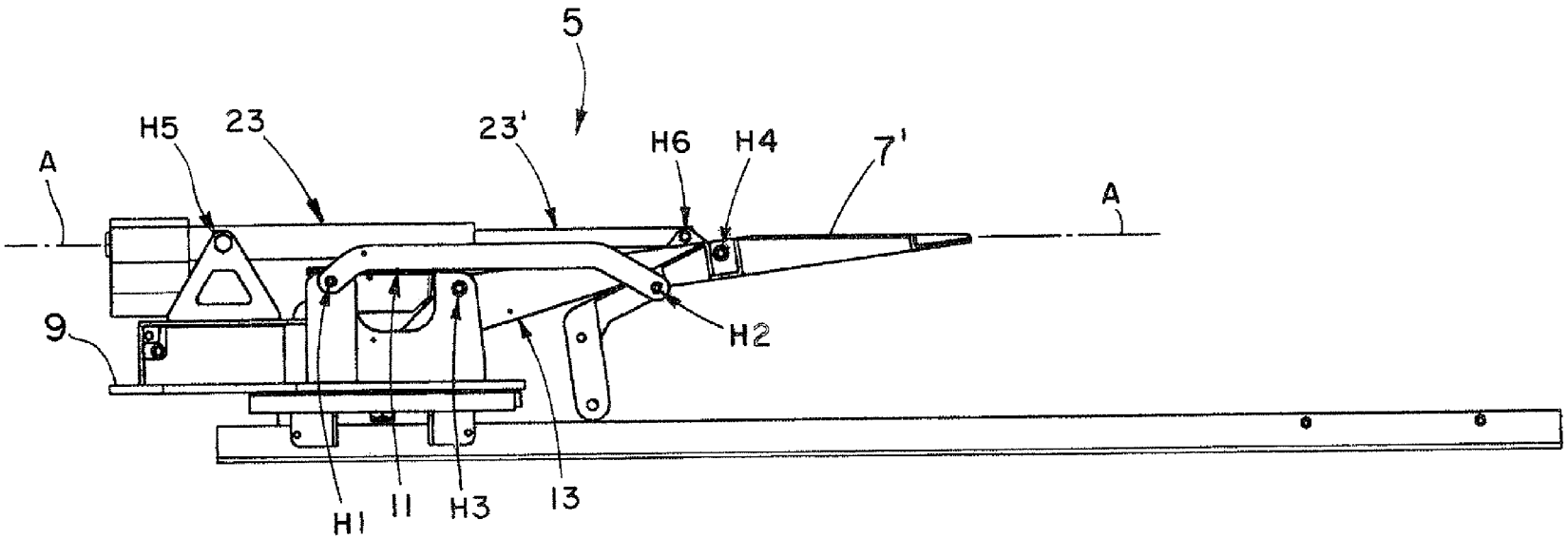
Figure 5:
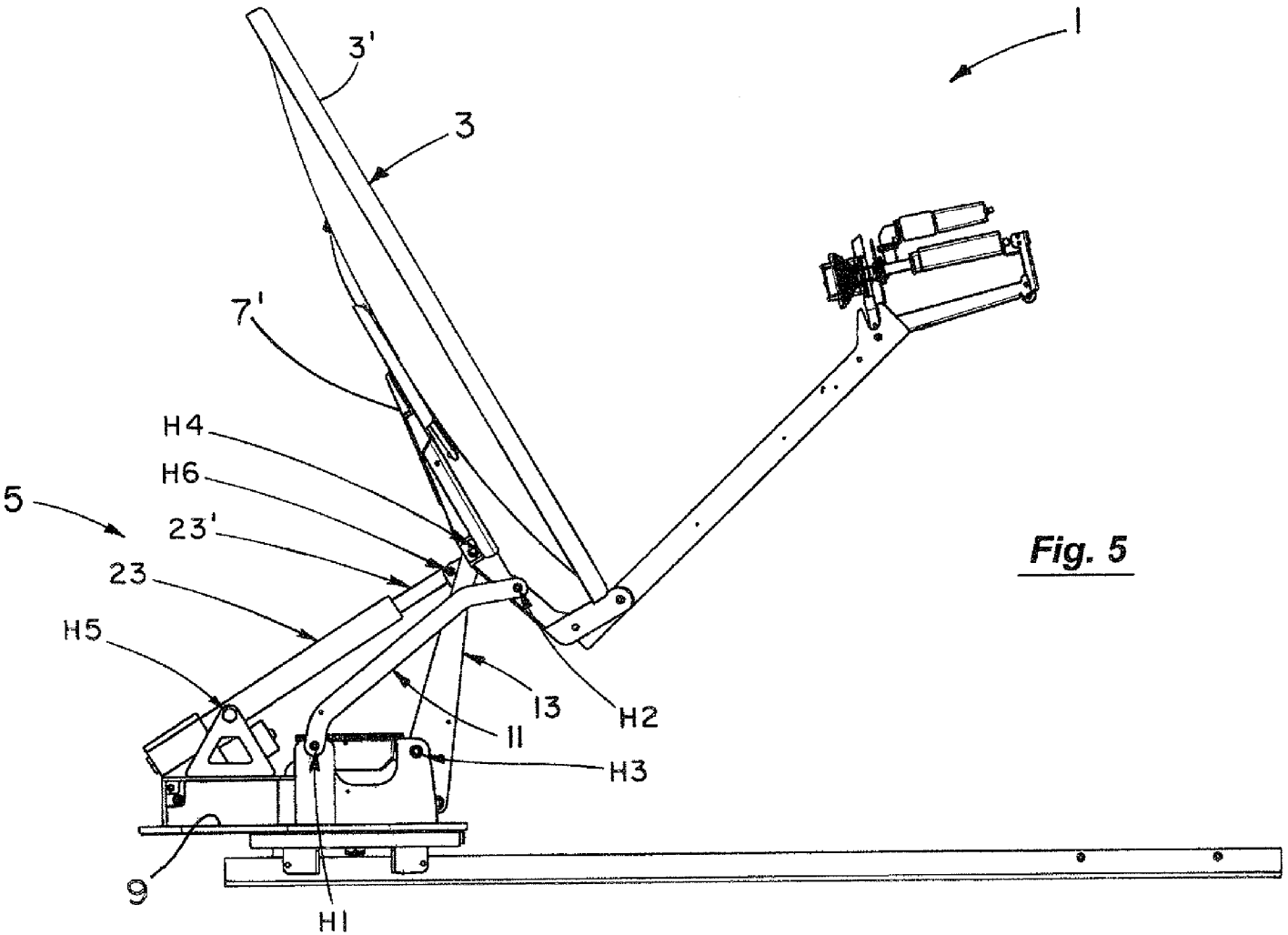
Figure 5A:
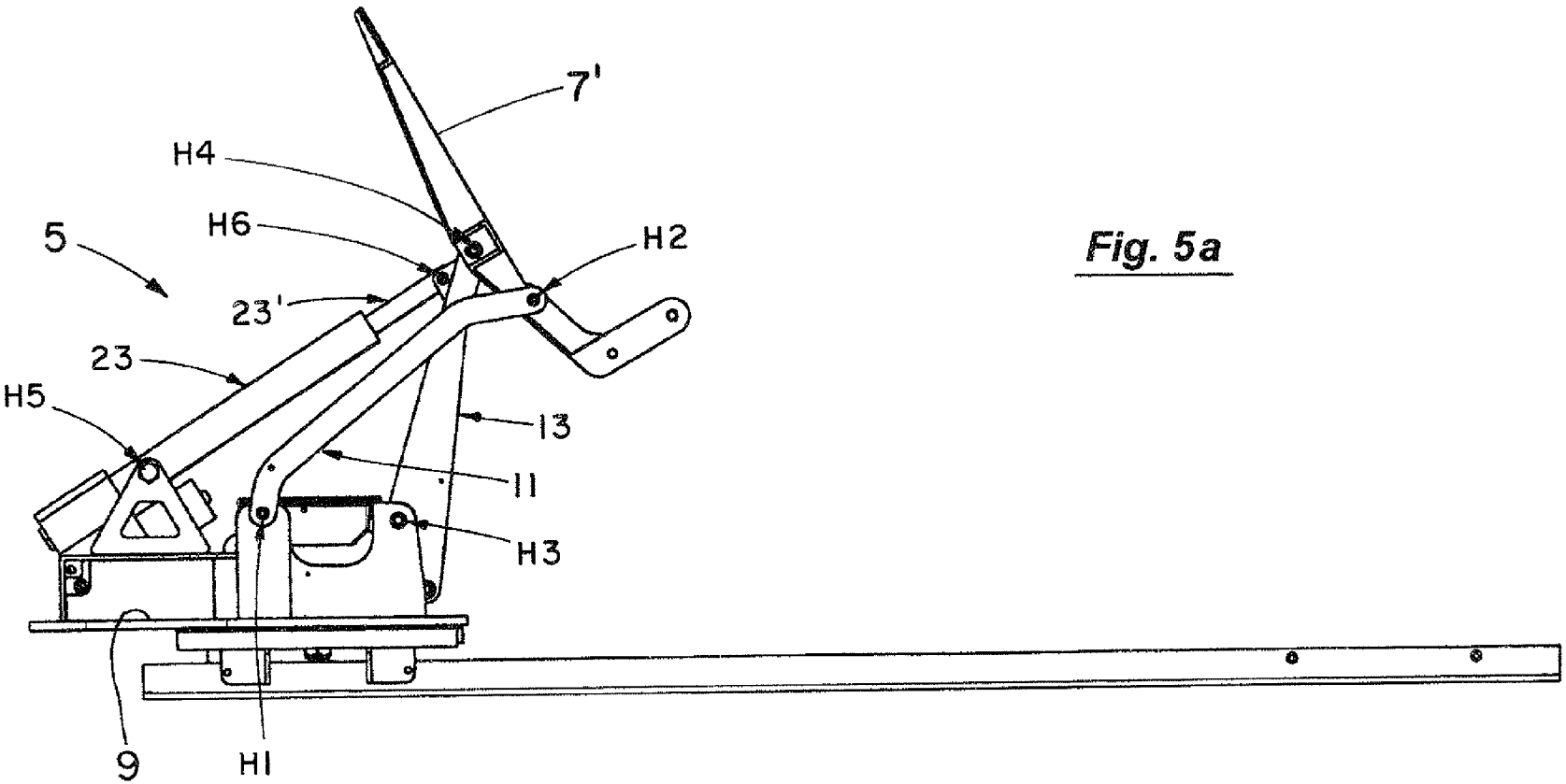
Figure 6:
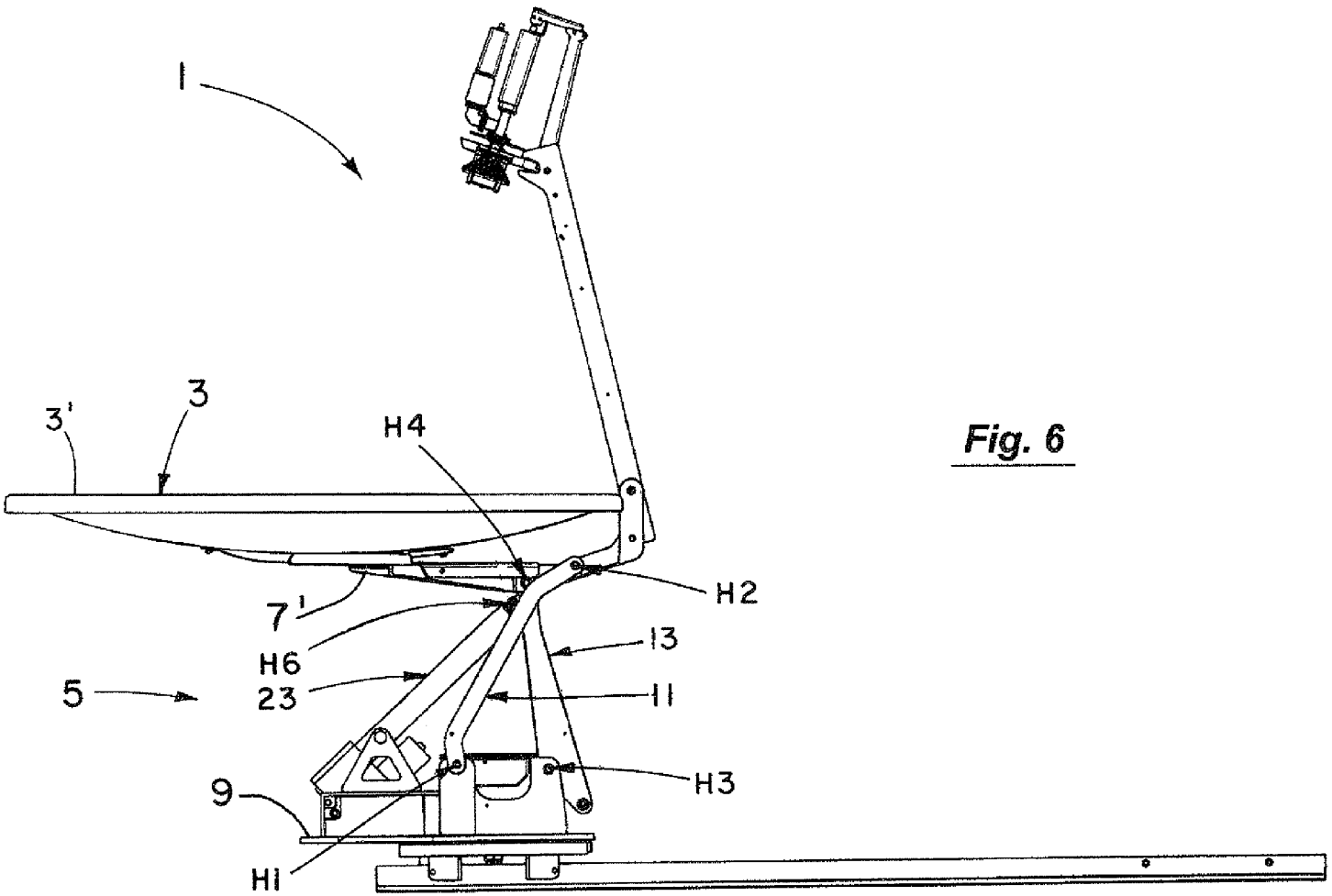
Figure 6A:
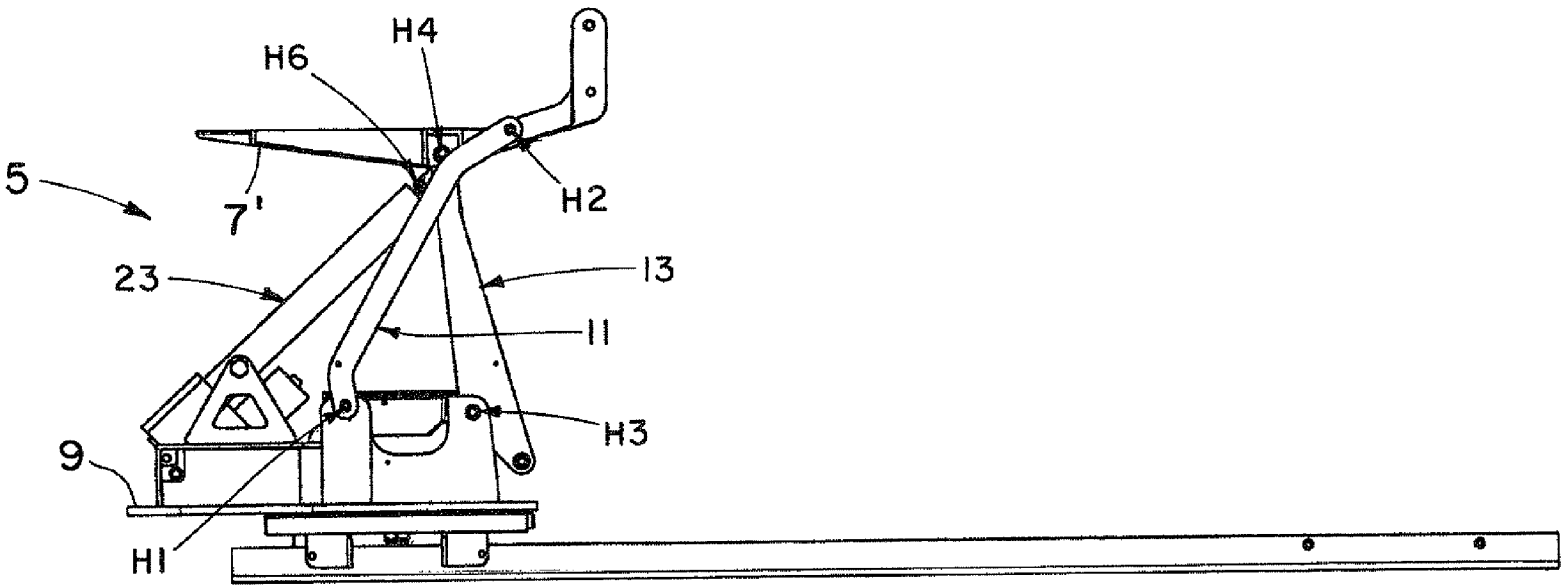

In operation as illustrated in the series of FIGS. 4-6 (with the main body of the dish member 3 shown) and in the companion series of FIGS. 4*a*-6*a* (with the main body of the dish member 3 removed for clarity), the satellite system 1 includes the elevation mechanism 5. The elevation mechanism 5 is designed to selectively raise and lower the dish member 3. The dish member 3 has front 3' and back 3" portions (FIG. 1) with the back portion 3" including a plate or similar structure 7 and affixed bracket 7' (see also FIGS. 2 and 3). When fully assembled as in FIGS. 1-6, the back plate 7 including the bracket 71 fixed thereto is part of the connection of the elevation mechanism 5 between the dish member 3 and the base or azimuth plate 9. In the lowered or stowed position of FIG. 4, the front portion 3' of the dish member 3 faces downwardly and in the deployed or raised position of FIG. 5 or 6, the front portion 3' of the dish member 3 faces upwardly above the horizon to target the satellite 8 of FIG. 1.

Figure 7:
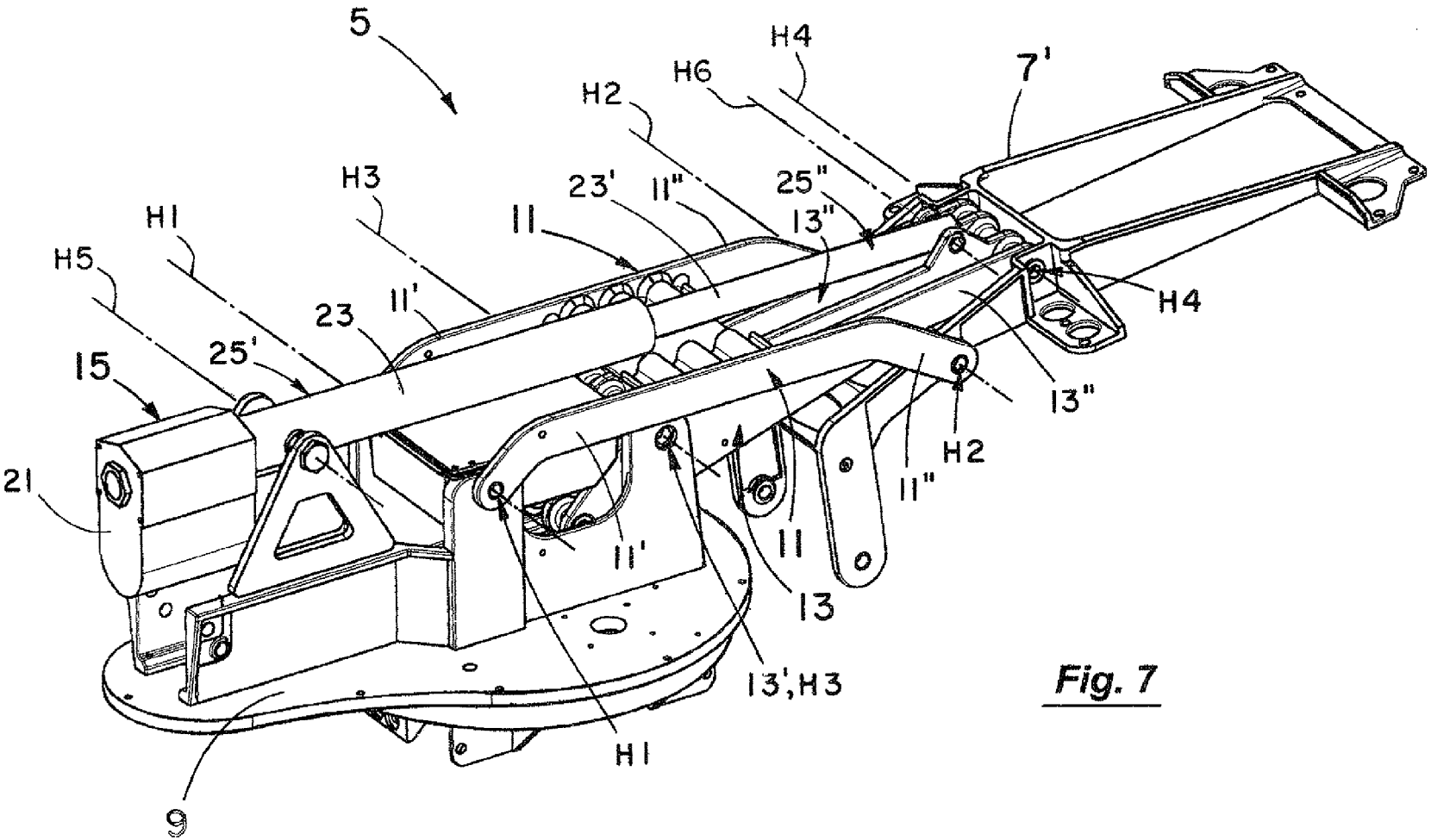
FIGS. 7-9 are sequential perspective views corresponding to the views of FIGS. 4*a*-6*a*.
Figure 7A:
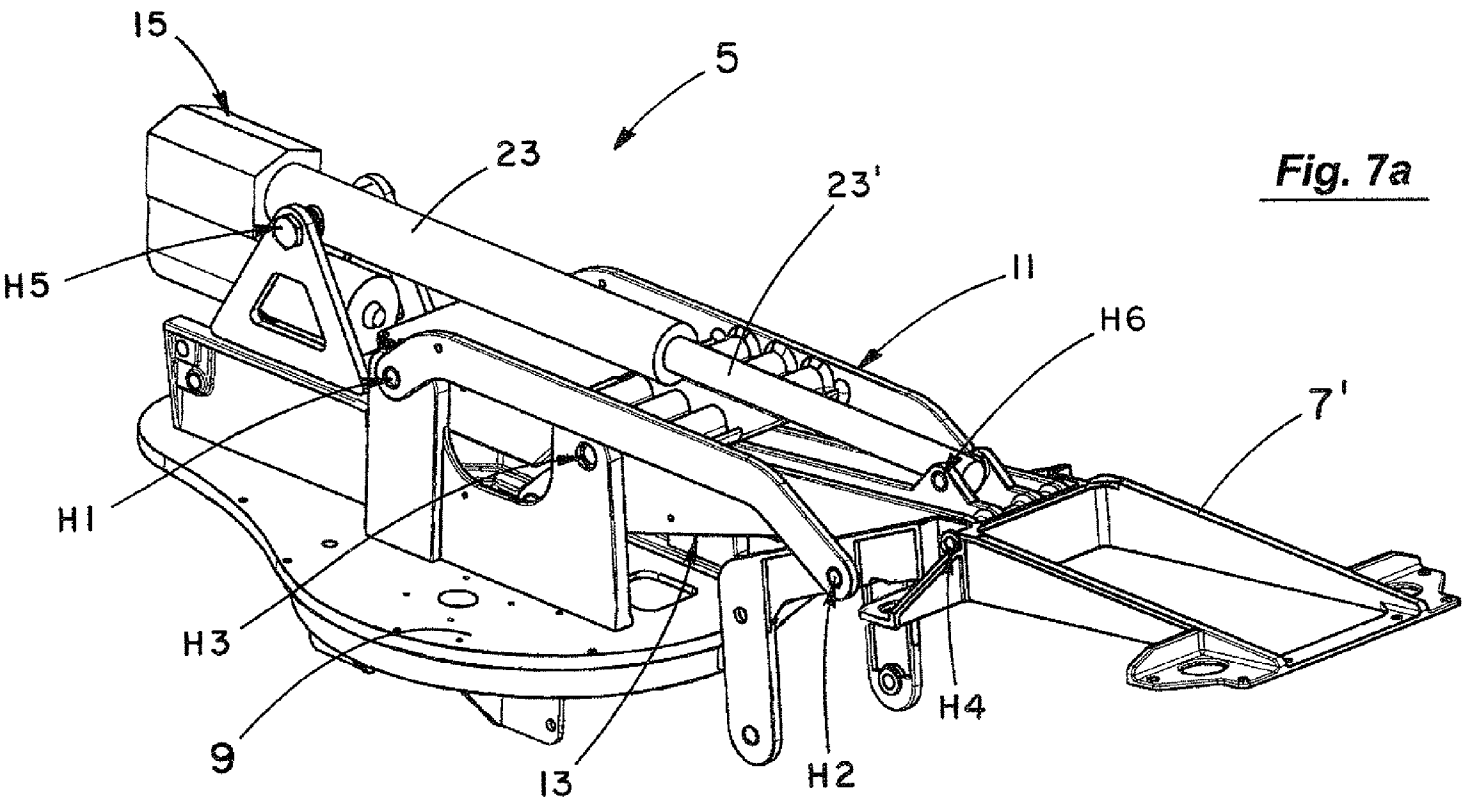
Figure 8:
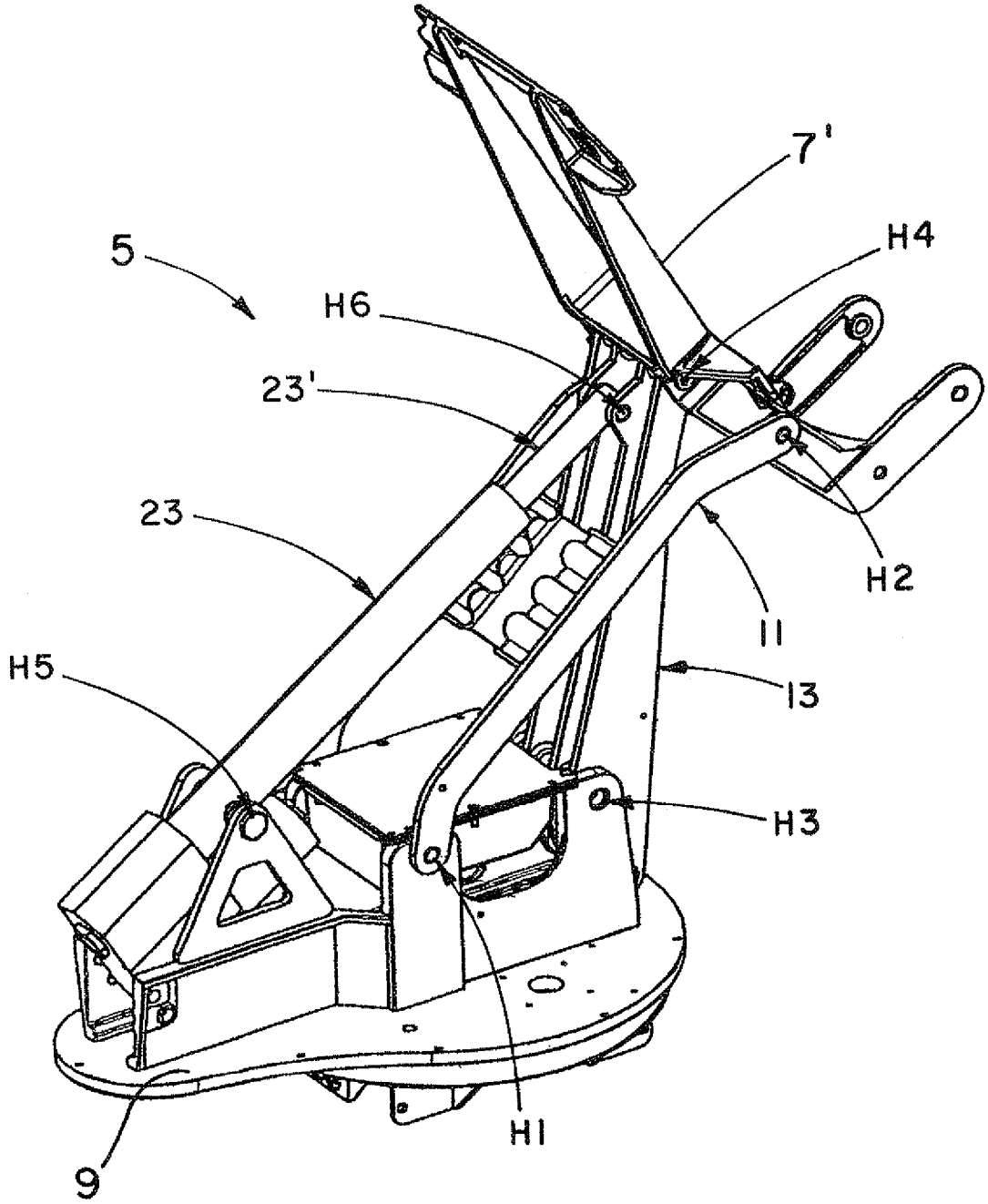
Figure 8A:
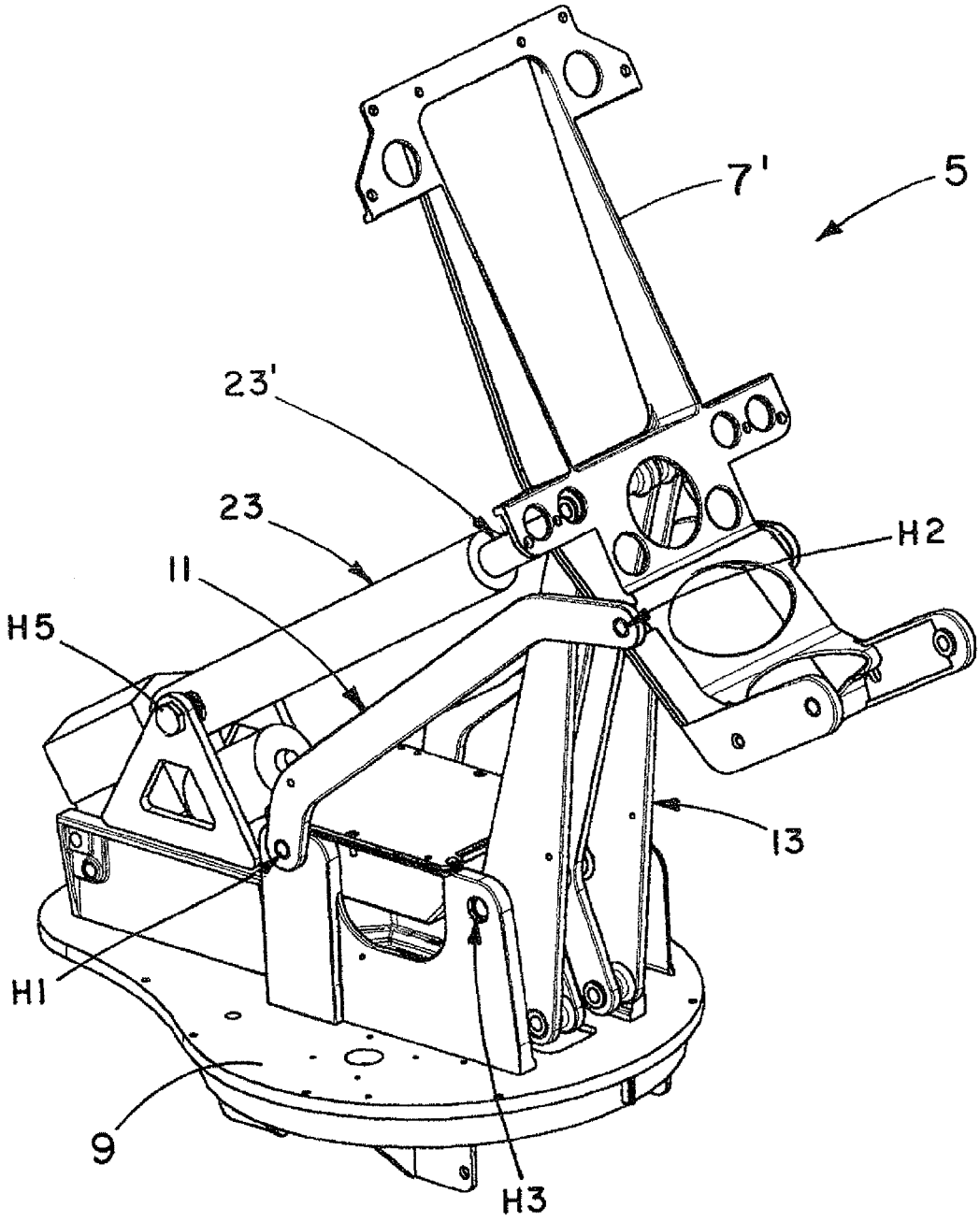
Figure 9:
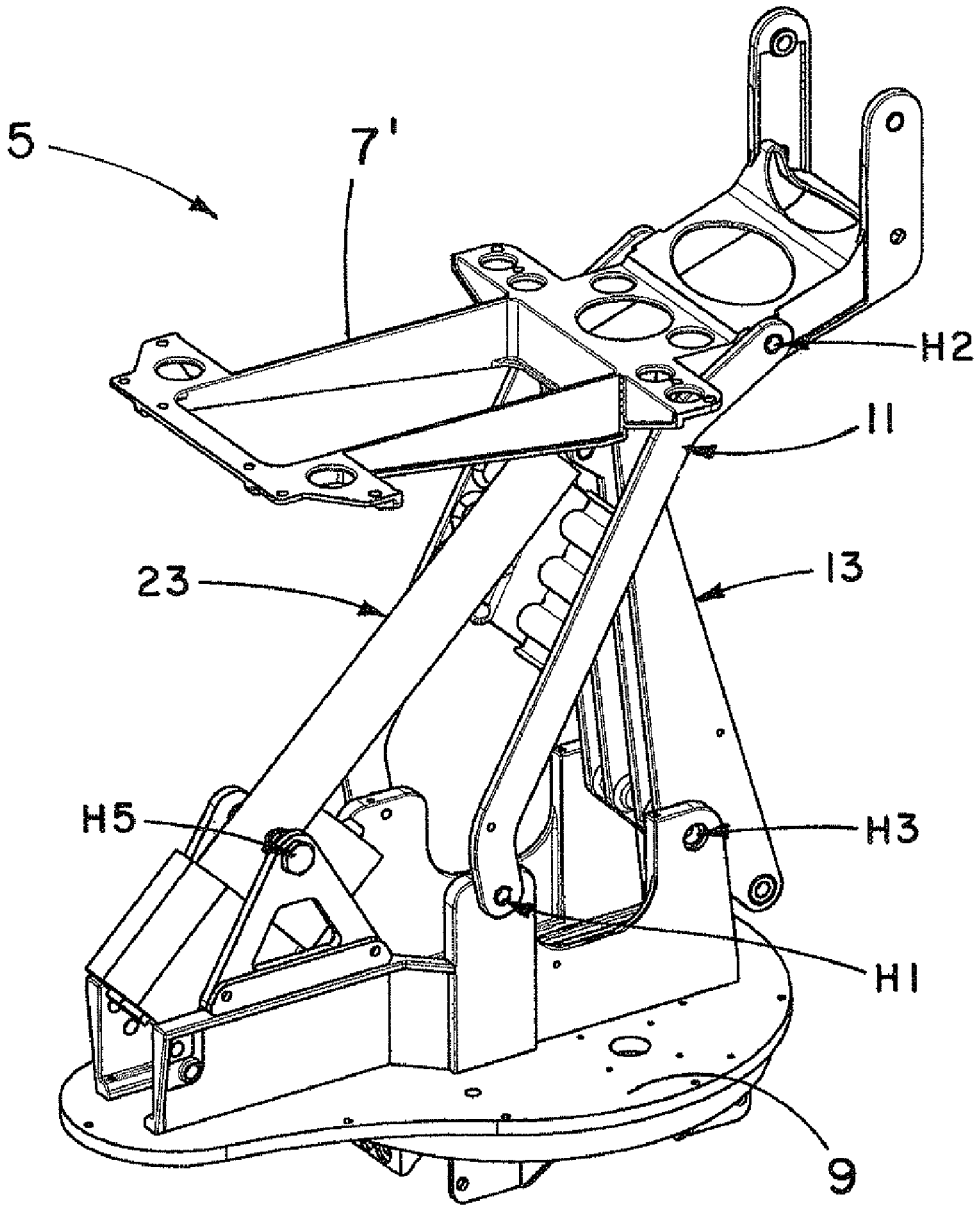
Figure 9A:
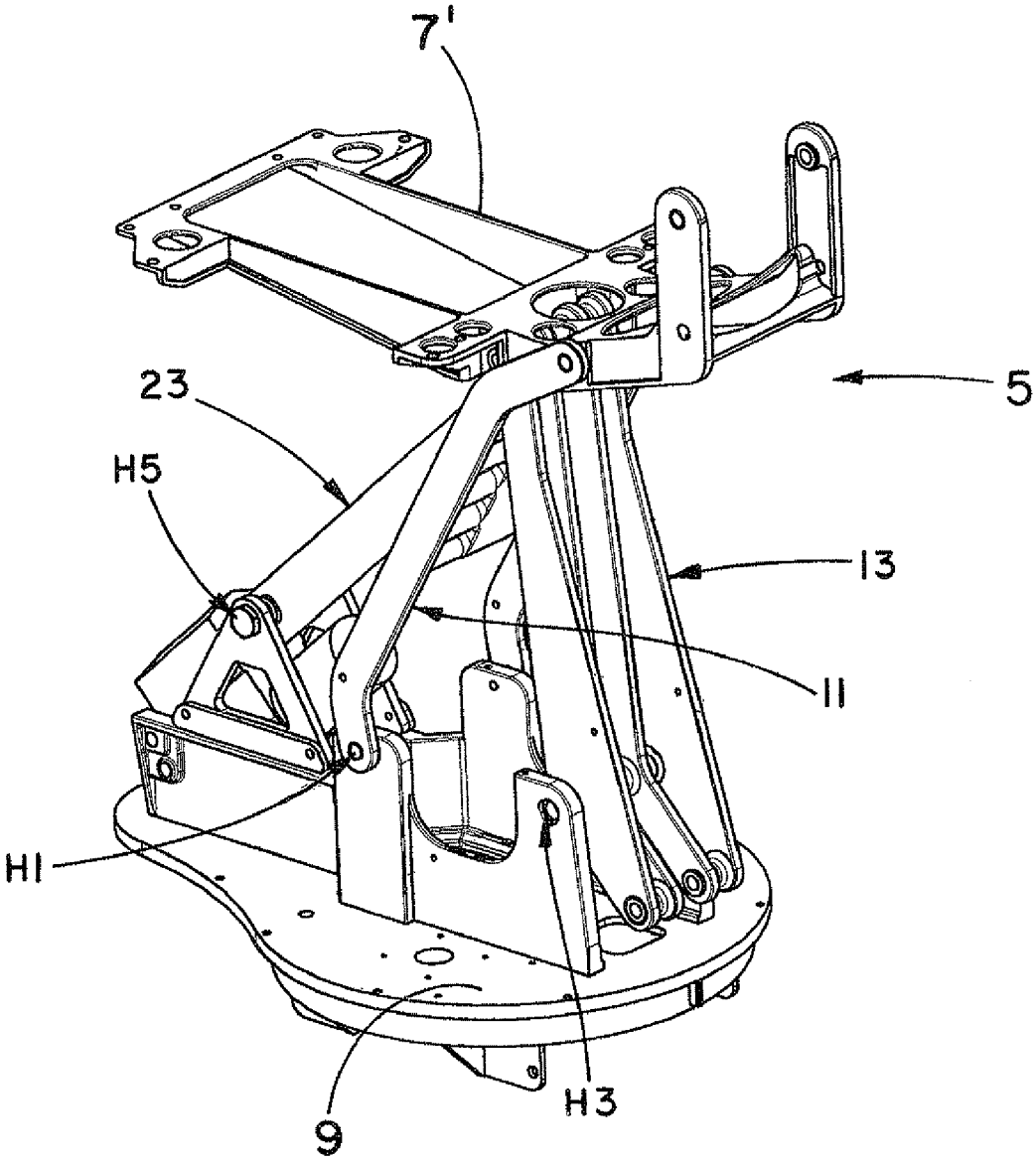

The elevation mechanism 5 of the present invention as best seen in FIGS. 4 and 7 includes the tilt links or arms 11, lift links 13, and linear actuator 15. The substantially parallel tilt arms 11 (see FIG. 7) are preferably elongated with each having an inner and outer end portion 11' and 11" (FIGS. 4 and 7). Each inner end portion 11' is mounted to the base 9 for pivotal movement about the substantially horizontal axis H1. Each outer end portion 11" in turn is mounted at plate bracket 7' to the back portion 3" of the dish member 3 for pivotal movement relative to the dish member 3 about the substantially horizontal axis H2 (FIGS. 4 and 7). The axes H1 and H2 are spaced from each other and are substantially parallel to one another. Similarly, the substantially parallel lift links 13 (FIG. 7) have inner and outer end portions 13', 13". Each inner and outer end portion 13',13" is respectively mounted to the base 9 and back portion 3" of the dish member 3 at plate bracket 7' (FIG. 4) for pivotal movement relative to the base 9 and dish member 3 about the substantially horizontal axes H3 and H4 (FIGS. 4 and 7). The axes H3 and H4 as illustrated are spaced from each other and are substantially parallel to one another. Additionally, the pairs of axes H1 and H3 and axes H2 and H4 are respectively spaced from and substantially parallel to one another.

The linear actuator 15 of the elevation mechanism 5 is of conventional design and has a motor drive 21 (FIGS. 4 and 7) and an elongated, adjustable leg arrangement 23,23'. The adjustable length leg arrangement 23,23' has inner and outer end portions 25', 25". The inner end portion 25' is mounted to the base 9 for pivotal movement about the substantially horizontal axis H5. The outer end portion 25" in turn is mounted for pivotal movement relative to the back portion 3" of the dish member 3 and the lift links 13 about the substantially horizontal axis H6. The outer end portion 25" is shown as being pivotally mounted to the lift links 13 with the axes H4 and H6 adjacent one another. However, the outer end portion 25" could be mounted to the plate bracket 7' of the dish back portion 3" at pivotal axis H4 if desired. Either way, the outer end portion 25" is mounted for pivotal movement relative to the back portion 3" of the dish member 3 and the lift links 13. In this last regard and as used throughout, the descriptions of the mountings are meant to include members mounted directly to each other as well as mounted adjacent to one another as long as the disclosed functions are still accomplished.

As illustrated, the adjustable length leg arrangement 23,23' is selectively movable between an extended position (FIGS. 4 and 4*a*) of a first length and a retracted position (FIGS. 5 and 5*b* or 6 and 6*b*) of a second length. The second length as shown is less than the first length. In this manner, the adjustable length arrangement 23,23' in the extended position of FIG. 4 causes the dish member 3 to move to the stowed position with the dish front portion 3' facing downwardly. The adjustable length arrangement 23,23' in a retracted position (FIG. 5 or 6) then causes the dish member 3 to move to a deployed position with the dish front portion 3' facing upwardly from the horizon toward the satellite 8 of FIG. 1. Such upward facing can vary as needed but typically is in the range of 15 to 90 degrees to the horizon.

The long stroke of the adjustable length leg arrangement 23,23' of the elevation mechanism 5 in comparison to prior designs allows for finer control of the deployed position for improved resolution. Additionally, the overall configuration of the elevation mechanism 5 provides a very strong and stable mounting for the dish member 3 in all positions and under virtually all conditions including high winds and snow.

The adjustable length arrangement 23,23' in this regard extends along an axis A (see FIGS. 4 and 4*a*) with the axis A substantially horizontal in the extended position of FIGS. 4 and 4*a*. In this position, the axis A is spaced above at least one of the axes H1, H2, and H3 (FIG. 4*a*). Preferably, the axis A is spaced above at least two of the axes H1, H2, and H3 and more preferably above all three axes in the position of FIGS. 4 and 4*a*. Additionally, the pivotal axis H5 of the inner end portion 25' of the linear actuator 15 is preferably spaced higher above the base or azimuth plate 9 than at least one of the axes H1 and H3 and more preferably higher than both axes. This configuration as discussed above then provides an elevation mechanism 5 that can achieve greater resolution and maintain it in use. The configuration also provides a very strong arrangement for moving the dish member 3 between its stowed and deployed positions even in adverse conditions of high winds and snow and provides a very stable support for the dish member 3 in all of its positions including under such adverse conditions.

The above disclosure sets forth a number of embodiments of the present invention described in detail with respect to the accompanying drawings. Those skilled in this art will appreciate that various changes, modifications, other structural arrangements, and other embodiments could be practiced under the teachings of the present invention without departing from the scope of this invention as set forth in the following claims.

I claim:

1. In a satellite antenna system having a base, a dish member with front and back portions, and an elevation mechanism connected between the base and dish member to selectively move the dish member between a stowed position with the front portion of the dish member facing downwardly and a deployed position with the front portion of the dish member facing upwardly, the improvement wherein said elevation mechanism includes:

at least one elongated tilt arm with an inner end portion mounted to said base for pivotal movement relative thereto about a first substantially horizontal axis and an outer end portion mounted to the back portion of the dish member for pivotal movement relative thereto about a second substantially horizontal axis spaced from and substantially parallel to said first horizontal axis, at least one elongated lift link with an inner end portion mounted to said base for pivotal movement about a third substantially horizontal axis spaced from and substantially parallel to said first horizontal axis and an outer end portion mounted to the back portion of said dish member for pivotal movement relative thereto about a fourth substantially horizontal axis spaced from and substantially parallel to said second horizontal axis, and a linear actuator with a motor and an elongated, adjustable length arrangement selectively movable between an extend portion of a first length and a retracted position of a second length less than said first length, said adjustable length arrangement having an inner end portion mounted to said base for pivotal movement relative thereto about a fifth substantially horizontal axis spaced from and substantially parallel to said first and third horizontal axes, said adjustable length arrangement further having an outer end portion mounted for pivotal movement relative to said back portion of the dish member and said lift link about a substantially horizontally linear axis, said substantially horizontally linear axis being located closer to the back portion of said dish member than said third horizontal axis is to said back portion with said dish member in said deployed position, said adjustable length arrangement in said extended position causing the dish member to move to said stowed position facing downwardly and said adjustable length arrangement in said retracted position causing said dish member to move to said deployed position facing upwardly.

2. The improvement of claim 1 wherein said second and fourth horizontal axes are substantially adjacent one another.

3. The improvement of claim 2 wherein the outer end portion of said adjustable length arrangement is mounted to said link arm for pivotal movement relative thereto about said horizontally linear axis.

4. The improvement of claim 1 wherein the adjustable length arrangement of the linear actuator extends along an axis and said axis with the adjustable length arrangement in the extended position is substantially horizontal and spaced above at least one of the first, second, and third horizontal axes.

5. The improvement of claim 4 wherein the axis of said adjustable length arrangement in the extended position is spaced above at least two of the first, second, and third horizontal axes.

6. The improvement of claim 1 wherein the adjustable length arrangement of the linear actuator extends along an axis and said axis with the adjustable length arrangement in the extended position is substantially horizontal and spaced above the first, second, and third horizontal axes.

7. The improvement of claim 1 wherein said fifth horizontal axis is spaced higher above said base than at least one of said first and third horizontal axes.

8. The improvement of claim 1 wherein said fifth horizontal axis is spaced higher above said base than said first and third horizontal axes.

9. In a satellite antenna system having a base, a dish member with front and back portions, and an elevation mechanism connected between the base and dish member to selectively move the dish member between a stowed position with the front portion of the dish member facing downwardly and a deployed position with the front portion of the dish member facing upwardly, the improvement wherein said elevation mechanism includes:

at least one elongated tilt arm with an inner end portion mounted to said base for pivotal movement relative thereto about a first substantially horizontal axis and an outer end portion mounted to the back portion of the dish member for pivotal movement relative thereto about a second substantially horizontal axis spaced from and substantially parallel to said first horizontal axis, at least one elongated lift link with an inner end portion mounted to said base for pivotal movement about a third substantially horizontal axis spaced from and substantially parallel to said first horizontal axis and an outer end portion mounted to the back portion of said dish member for pivotal movement relative thereto about a fourth substantially horizontal axis spaced from and substantially parallel to said second horizontal axis, and a linear actuator with a motor and an elongated, adjustable length arrangement selectively movable between an extend portion of a first length and a retracted position of a second length less than said first length, said adjustable length arrangement having an inner end portion mounted to said base for pivotal movement relative thereto about a fifth substantially horizontal axis spaced from and substantially parallel to said first and third horizontal axes, said adjustable length arrangement further having an outer end portion mounted for pivotal movement relative to said back portion of the dish member and said lift link about a substantially horizontally linear axis, said adjustable length arrangement in said extended position causing the dish member to move to said stowed position facing downwardly and said adjustable length arrangement in said retracted position causing said dish member to move to said deployed position facing upwardly wherein said second and fourth horizontal axes are substantially adjacent one another and wherein the outer end portion of said adjustable length arrangement is mounted to said link arm for pivotal movement relative thereto about said substantially horizontally linear axis.

10. The improvement of claim 1 further including a second, elongated tilt arm and a second, elongated lift link with respective inner and outer portions respectively mounted to said base and said back portion of the dish member for respective pivotal movement relative thereto about the respective first, second, third, and fourth horizontal axes.

11. The improvement of claim 10 wherein said first and second tilt arms are substantially parallel to each other and said first and second lift links are substantially parallel to each other.

12. In a satellite antenna system having a base, a dish member with front and back portions, and an elevation mechanism connected between the base and dish member to selectively move the dish member between a stowed position with the front portion of the dish member facing downwardly and a deployed position with the front portion of the dish member facing upwardly, the improvement wherein said elevation mechanism includes:

at least one elongated tilt arm with an inner end portion mounted to said base for pivotal movement relative thereto about a first substantially horizontal axis and an outer end portion mounted to the back portion of the dish member for pivotal movement relative thereto about a second substantially horizontal axis spaced from and substantially parallel to said first horizontal axis, at least one elongated lift link with an inner end portion mounted to said base for pivotal movement about a third substantially horizontal axis spaced from and substantially parallel to said first horizontal axis and an outer end portion mounted to the back portion of said dish member for pivotal movement relative thereto about a fourth substantially horizontal axis spaced from and substantially parallel to said second horizontal axis, and a linear actuator with a motor and an elongated, adjustable length arrangement selectively movable between an extend portion of a first length and a retracted position of a second length less than said first length, said adjustable length arrangement having an inner end portion mounted to said base for pivotal movement relative thereto about a fifth substantially horizontal axis spaced from and substantially parallel to said first and third horizontal axes, said adjustable length arrangement further having an outer end portion mounted for pivotal movement relative to said back portion of the dish member and said lift link about a substantially horizontally linear axis, said adjustable length arrangement in said extended position causing the dish member to move to said stowed position facing downwardly and said adjustable length arrangement in said retracted position causing said dish member to move to said deployed position facing upwardly wherein the adjustable length arrangement of the linear actuator extends along and about a substantially central axis and said central axis with the adjustable length arrangement in the extended position is substantially horizontal and spaced above at least one of the first, second, and third horizontal axes.

13. The improvement of claim 12 wherein the central axis of said adjustable length arrangement in the extended position is spaced above at least two of the first, second, and third horizontal axes.

14. The improvement of claim 12 wherein the central axis of said adjustable length arrangement in the extended position is substantially horizontal and spaced above the first, second, and third horizontal axes.

15. In a satellite antenna system having a base, a dish member with front and back portions, and an elevation mechanism connected between the base and dish member to selectively move the dish member between a stowed position with the front portion of the dish member facing downwardly and a deployed position with the front portion of the dish member facing upwardly, the improvement wherein said elevation mechanism includes:

at least one elongated tilt arm with an inner end portion mounted to said base for pivotal movement relative thereto about a first substantially horizontal axis and an outer end portion mounted to the back portion of the dish member for pivotal movement relative thereto about a second substantially horizontal axis spaced from and substantially parallel to said first horizontal axis, at least one elongated lift link with an inner end portion mounted to said base for pivotal movement about a third substantially horizontal axis spaced from and substantially parallel to said first horizontal axis and an outer end portion mounted to the back portion of said dish member for pivotal movement relative thereto about a fourth substantially horizontal axis spaced from and substantially parallel to said second horizontal axis, and a linear actuator with a motor and an elongated, adjustable length arrangement selectively movable between an extend portion of a first length and a retracted position of a second length less than said first length, said adjustable length arrangement having an inner end portion mounted to said base for pivotal movement relative thereto about a fifth substantially horizontal axis spaced from and substantially parallel to said first and third horizontal axes, said adjustable length arrangement further having an outer end portion mounted for pivotal movement relative to said back portion of the dish member and said lift link about a substantially horizontally linear axis, said adjustable length arrangement in said extended position causing the dish member to move to said stowed position facing downwardly and said adjustable length arrangement in said retracted position causing said dish member to move to said deployed position facing upwardly wherein said fifth horizontal axis is spaced higher above said base than at least one of said first and third horizontal axes.

16. The improvement of claim 15 wherein said fifth horizontal axis is spaced higher above said base than both said first and third horizontal axes.

* * * * *